US005192224A

United States Patent [19]

Bernardini

[11] Patent Number: 5,192,224

[45] Date of Patent: Mar. 9, 1993

[54] CONNECTOR BACKSHELL FOR USE WITH FLEXIBLE CONDUIT WITH AN INTERNAL STRAIN RELIEF CLAMP

[75] Inventor: Allen J. Bernardini, Southbury, Conn.

[73] Assignee: Litton Systems, Inc., Watertown, Conn.

[21] Appl. No.: 839,934

[22] Filed: Feb. 19, 1992

[51] Int. Cl.[5] ..... H01R 13/56; H01R 13/58

[52] U.S. Cl. ..... 439/471; 439/464

[58] Field of Search ..... 439/460, 464, 470, 471

[56] References Cited

U.S. PATENT DOCUMENTS

| | | | |
|---|---|---|---|
| 3,792,417 | 2/1974 | Punaro | 439/471 |
| 3,823,254 | 7/1974 | Smith | 174/92 |
| 4,289,288 | 9/1981 | Gransberry et al. | 248/56 |
| 4,317,953 | 3/1982 | Brownell et al. | 174/21 R |
| 4,358,178 | 11/1982 | Guy | 339/103 R |
| 4,406,041 | 9/1983 | DeAnda et al. | 24/115 R |
| 4,432,592 | 2/1984 | Boutros et al. | 339/103 M |
| 4,659,164 | 4/1987 | Reuss | 339/143 R |
| 4,679,869 | 7/1987 | Watson | 439/78 |
| 4,808,123 | 2/1989 | Dee et al. | 439/470 |
| 4,822,286 | 4/1989 | Bianca | 439/610 |
| 4,842,547 | 6/1989 | Defibaugh et al. | 439/460 |
| 4,842,550 | 6/1989 | Fry, Jr. et al. | 439/471 |
| 4,863,401 | 9/1989 | Talend | 439/610 |
| 5,030,111 | 7/1991 | Eastman | 439/452 |

OTHER PUBLICATIONS

Band-IT Instructions Tie-Dex Band-Part Number A100.

*Primary Examiner*—Eugene F. Desmond
*Attorney, Agent, or Firm*—Brian L. Ribando

[57] ABSTRACT

A finger is provided on the backshell extension of a heavy duty multi-pin connector to provide an attachment point for a strain relief band. The strain relief band prevents strain on a conductor bundle in response to flexure of a protective hose which is mounted on the backshell extension. The strain relief band may be similar in construction to the hose band which is used to secure the protective hose on the backshell extension.

5 Claims, 1 Drawing Sheet

Fig_1
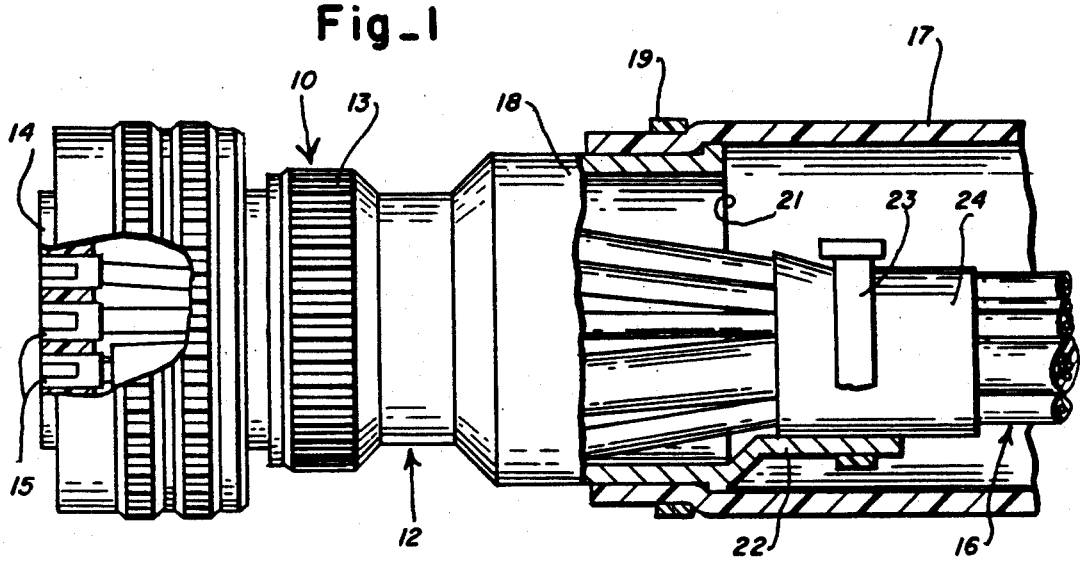
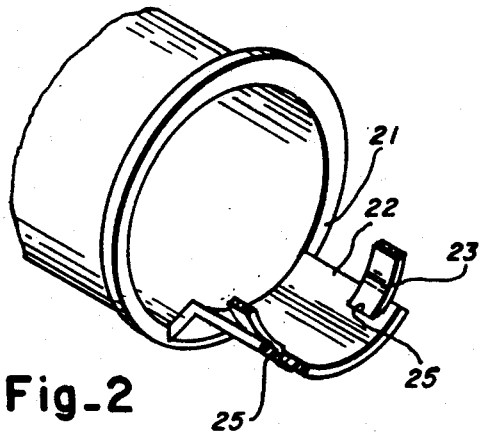
Fig_2
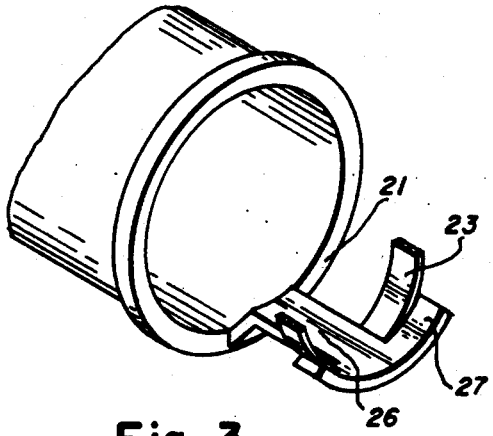
Fig_3

CONNECTOR BACKSHELL FOR USE WITH FLEXIBLE CONDUIT WITH AN INTERNAL STRAIN RELIEF CLAMP

BACKGROUND OF THE INVENTION

The invention relates to a connector backshell in a heavy duty multi-pin connector which provides strain relief for a wire bundle or cable and a means for attaching a flexible hose or conduit to shield the wires or cable from the environment.

The transportation industry requires heavy duty multi-pin connectors which are rugged enough to withstand the weather conditions to which they are subjected as well as the physical beating which they take as a result of being subjected to oil, grease, and bombardment by road debris. The individual wires or cables which are coupled to the connectors are often housed in a rugged conduit or hose which is attached to the end of the connector backshell and protects the wires from the outside environment. The transportation industry recognizes the use of certain metal or plastic banding which is fixed by a machine or a hand tool to attach the conduit to the rear of a connector backshell.

Although the wires or cable are thus protected from the outside environment, they are loose inside the conduit and flex in response to flexure of the conduit. Such movement jeopardizes the connection of the wires to the electrical contacts of the connector, and open or short circuits can result if the connections are broken.

It would thus be desirable to provide a means for securing individual wires or cables relative to a connector backshell so that they are not free to move and flex in response to the movement of the conduit which protects them from the environment.

SUMMARY AND OBJECTS OF THE INVENTION

According to the invention, a connector backshell is provided with a protruding finger which provides an attachment point for a band which may be wrapped around a bundle of conductors in order to secure the conductors to the finger. The finger is dimensioned to fit within the confines of an outer protective conduit. A rubber or plastic bushing is used to protect the conductors from the band, and the combination of the band and the finger provides strain relief for the bundle. Attachment means may be provided for securing the band to the finger.

It is accordingly an object of the invention to provide an attachment point on the connector backshell of a heavy duty multi-pin connector for securing a bundle of conductors in place.

It is another object of the invention to provide an extending finger on the rear of a backshell to receive a band which encircles conductors connected to the backshell and provides a strain relief for conductors.

It is another object of the invention to provide a strain relief for conductors which are connected to a backshell and are surrounded by a conduit for protecting the conductors from the outside environment.

These and other objects of the invention will become apparent from the following detailed description in which numerals used throughout the description correspond to those found in the drawing figures.

BRIEF DESCRIPTION OF THE DRAWINGS

FIG. 1 is a side view partly in section of a multi-pin connector with a backshell having an outer protective conduit and a strain relief mechanism for a bundle of conductors.

FIGS. 2 and 3 show two embodiments of a finger or attachment point on a backshell used in conjunction with a strain relief band.

DESCRIPTION OF THE PREFERRED EMBODIMENT

Referring to the drawing figures, FIG. 1 shows a heavy duty multi-pin connector 10 comprising a plugshell 11 coupled to a backshell 12 by means of a threaded coupling 13. An insert 14 is mounted in the plugshell 11 and a plurality of electrical terminals 15 are mounted in the insert 14. Each electrical terminal 15 is soldered or crimped to the end of a conductor 16 which may be one of a plurality of individual wires or one of a plurality of wires which comprise an electrical cable. The electrical terminals 15 mate with complementary terminals in a mating connector (not shown).

In order to provide environmental protection for the conductors 16 which protrude from the rear of the backshell 12, a rugged conduit or hose 17 is placed over the conductors 16 and is removably mounted on a backshell extension 18. A metal or plastic hose band 19 is used to secure the hose 17 to the backshell extension and provides a watertight connection thereto. Such hose bands are well known in the art and their use for securing the hose 17 to the backshell extension 18 forms no part of the instant invention. The hose band may be loosened, and the hose 17 may be removed from the backshell extension 18 to provide access to the conductors and the interior of the connector for inspection or repair purposes. While the hose 17 provides protection for the conductors 16 from the external environment, the conductors are left loose and flex and become strained in response to flexing of the protective hose 17. The strain on the conductors 16 jeopardizes the connection between the conductor ends and the terminals 15, and open or short circuits often result.

According to the invention, the rear 21 of the backshell extension 18 is formed with a protruding finger 22. The finger 22 provides an anchor or attachment point for a strain relief band 23 which is wrapped around the conductors 16 and around the finger 22. A bushing 24 of rubber, plastic, or other suitable material may be used to protect the conductors from the strain relief band 23. The strain relief band 23 is cinched tightly around the conductors 16, the finger 22 and the bushing 24 by the buckle 30, and preferably comprises the same material as the hose band 19. The combination of the strain relief band 23 and the finger 22 is dimensioned to fit inside the hose 17 and provides a strain relief for the bundle of conductors 16.

FIGS. 2 and 3 show various embodiments of a finger used to provide an attachment point for the strain relief band 23. In FIG. 2, the finger 22 is arcuate shaped, and includes two slots 25 through which the band 23 is threaded. The slots 25 hold the band in a fixed position and prevent forward or backward slipping of the band, and of the conductors which may be held thereby. In FIG. 3, a finger 26 terminates in a T-shaped end 27, and the arms of the T limit the rearward slippage of the band 23.

The use of a band for strain relief purposes rather than deformable tabs attached to the end of the finger 22 allows any number and combination of wires and cables to be secured in place without regard to the size of the resulting conductor bundle. Through the use of the strain relief band, flexing or motion of the hose 17 is not transmitted to the ends of the conductors 16 which are attached to the electrical terminals 15.

Having thus described the invention, various alterations and modifications thereof will be apparent to those skilled in the art, which modifications and alterations are intended to be within the scope of the invention as defined by the appended claims.

What is claimed is:

1. A heavy duty multi-pin connector for use with a protective hose comprising:

a plugshell and an insert having a plurality of electrical terminals mounted therein;

a backshell coupled to the plugshell;

a plurality of conductors extending through the backshell and the plugshell and coupled to the electrical terminals;

a backshell extension on the rear of the backshell;

a protective hose removably mounted on the backshell extension and means for securing the protective hose to the backshell extension;

means for providing a strain relief for the plurality of conductors coupled to the electrical terminals, said means comprising a protruding finger extending from the rear of the backshell extension and a strain relief band encircling the protruding finger and the plurality of conductors, whereby the plurality of conductors are secured to the protruding finger by the strain relief band; and a protective bushing between the strain relief band and the plurality of conductors.

2. The multi-pin connector of claim 1 further comprising:

means for attaching the strain relief band to the protruding finger.

3. The multi-pin connector of claim 2 further comprising:

a pair of slots in the protruding finger whereby the strain relief band is threaded through the pair of slots, and the slots prevent forward or rearward slippage of the strain relief band.

4. The multi-pin connector of claim 1 further comprising:

a T-shaped end on the protruding finger, whereby the arms of the T prevent limit the rearward slippage of the strain relief band.

5. The multi-pin connector of claim 1 wherein the strain relief band comprises a band of material having the same construction as the means for securing the protective hose to the backshell extension.

* * * * *